US005634494A

United States Patent [19]

Martens

[11] Patent Number: 5,634,494

[45] Date of Patent: Jun. 3, 1997

[54] CONTROL ARRANGEMENT FOR A SHUTOFF VALVE ACTUATABLE BY NEGATIVE PRESSURE

[75] Inventor: Peter Martens, Hamburg, Germany

[73] Assignee: Roediger Anlagenbau-GmbH, Hanau, Germany

[21] Appl. No.: 357,035

[22] Filed: Dec. 16, 1994

[30] Foreign Application Priority Data

Dec. 21, 1993 [DE] Germany ..... 43 43 733.8

[51] Int. Cl.[6] ..... E03B 7/07; E03F 1/00

[52] U.S. Cl. ..... 137/624.11; 137/205; 137/907

[58] Field of Search ..... 137/624.11, 205, 137/907, 236.1, 624.18

[56] References Cited

U.S. PATENT DOCUMENTS 3,538,517 11/1970 Cornish et al. ..... 137/624.18 X 4,373,838 2/1983 Foreman et al. ..... 137/236.1 X

FOREIGN PATENT DOCUMENTS 3727661 3/1989 Germany .

*Primary Examiner*—Kevin Lee

*Attorney, Agent, or Firm*—Dennison, Meserole, Pollack & Scheiner

[57] ABSTRACT

The invention relates to a control arrangement (10) for a shutoff valve, actuated by application of negative pressure, for use in a negative pressure wastewater system. The control arrangement includes a chamber (28) in which a main piston (22) is displaced as a function of negative pressure and a driver by way of which valves (70, 72) are actuated so as to operate independently of each other; the valves (70, 72) transmit or inhibit negative pressure to open or close a wastewater aspiration valve and a ventilation valve.

20 Claims, 10 Drawing Sheets

CONTROL ARRANGEMENT FOR A SHUTOFF VALVE ACTUATABLE BY NEGATIVE PRESSURE

BACKGROUND OF THE INVENTION

The invention relates to a control arrangement for a shutoff valve actuatable by negative pressure and intended for a negative pressure wastewater system, including a first valve that is actuatable by hydrostatic pressure resulting from accumulated water and that closes or opens a connection that carries negative pressure, a chamber which is pressure-adjustable via the first valve and in which or adjacent to which a main piston preferably acted upon by a spring is displaceably disposed, by means of which piston a negative pressure connection to at least the shutoff valve is controllable as a function of the pressure prevailing in the chamber. At least one second valve is provided, independent of the main piston but positively coupled to it preferably via a driver, by way of this second valve the shutoff valve can be connected upon by negative pressure.

In order to keep bodies of water clean, the wastewater must reach sewage treatment plants. Often, however, this is not possible, either because of disproportionately high costs for conventional sewer systems or because of problematic local conditions, such as the lack of a natural slope, low housing density and unfavorable subsoil, or the fact that the sewer system would have to pass through a groundwater protection area. Even for such problem cases, however, the possibility exists of undertaking sewage treatment, whenever negative pressure drainage or a "vacuum sewer system" is employed.

A corresponding vacuum sewer system includes as its essential components home connection shafts with a control arrangement operating shutoff or aspiration valves without electric current, with an adjoining pipeline system with systematically disposed high and low points, and a vacuum station with wastewater collecting tanks, wastewater pumps, vacuum pumps, and measurement and control systems.

The wastewater first flows out of buildings via conventional gravity drains to shafts, which for example are located at the boundary of premises, and in which the exclusively pneumatically controlled shutoff valves and the associated control arrangement are accommodated.

By means of the mechanism present in the control arrangement, the shutoff valve is opened in the presence of a predetermined hydrostatic pressure, and the wastewater is aspirated into the vacuum line. The valve closes in time-dependent fashion after a few seconds, by spring force and vacuum.

The wastewater itself collects at the low points in the pipeline system and is gradually pushed by incoming air across the ensuing high points in the direction of the vacuum station. From the collecting tank in the vacuum station, the wastewater is then pumped to the sewage treatment plant with conventional wastewater pumps, via a pressure or gravity sewer.

The control arrangement associated with the shutoff valve is intended to enable automatic adaptation both to the batches of wastewater to be aspirated, and to the operating conditions in the drainage pipeline system.

To enable timing control via the pressure-adjustable chamber in a control arrangement known by the trade name "AIRVAC", bores of small diameter, which can easily become plugged, are necessary and the result is that functioning is no longer assured. Moreover, an unequivocal open/closed position of the second valve, transmitting the negative pressure to the shutoff valve, does not exist. This means that the quantity of wastewater or of the mixture of wastewater and air per opening stroke of the shutoff valve is not unequivocally defined. Particularly when there is a large amount of wastewater, this can cause disruptions to operation. It is also disadvantageous that the aspiration time is dependent on the existing negative pressure, in a way which is unfavorable to the overall system, since the opening times in turn are dependent on the prevailing negative pressure. Thus at pronounced negative pressure, the opening time is longer than at slight negative pressure. As an unfavorable result, when the negative pressure is slight less air is aspirated than when the negative pressure is pronounced, even though what would be desired is the opposite.

It is also disadvantageous that an opening of the second valve that enables the negative pressure to reach the shutoff valve can occur at even a slight negative pressure, which nevertheless is inadequate for the aspiration. As a result, the danger is increased that wastewater can be lifted into the frost zone of the pipeline and freeze there.

In order to enable reception of large quantities of water or to enable restarting plants whose operation had been interrupted for a relatively long period of time, it is highly advantageous if the wastewater is aspirated in batches, and if air is aspirated into the negative pressure wastewater system via a valve after each batch. This provides the advantage that if there is a large amount of water or if the storage spaces are nearly overfilled, large columns of water will not be produced in the pipeline system, which could otherwise hinder transport of water.

A control arrangement of the type referred to at the outset can be learned from German Patent Disclosure DE 37 27 661 A1. In order to assure precise adjustment and reliable function of the control device, not only a first valve actuated by a hydrostatic pressure and a structurally complicated timing control acting by way of volumetric change rather than pressure change, but also at least one control valve and optionally at least one minimum negative pressure valve are necessary. Because of the complex mechanical structure specifically of the timing control device, which includes among other elements a diaphragm piston with a hollow protrusion that is guided in a guide bush and which also includes a bracket that acts in turn upon a pivotable actuating lever in order to open or close the weighted control valve, it is not always assured that the control arrangement will operate with the requisite reliability. The known control arrangement is capable of actuating either one control valve or a second control valve disposed downstream of it; these valves jointly trigger a single shutoff valve.

OBJECTIONS OF THE INVENTION

The object of the present invention is to improve a control arrangement of the type referred to above in such a way that while having a compact and structurally simple design, great operating reliability is assured, whereby via the main piston a negative pressure connection to one or several shutoff valves can be controlled. If there are at least two triggerable valves, preferably one for wastewater and one for air, it should be possible to act upon them either simultaneously, at overlapping times, or in succession, with the negative pressure required for their actuation.

This object is essentially attained in that the control arrangement includes a third valve, which is positively coupled to the main piston and which controls a connection with a further shutoff valve or with a ventilation valve that delivers air into the negative pressure wastewater system.

SUMMARY OF THE INVENTION

The control arrangement according to the invention is universally usable; that is, a desired use can be achieved, as a function of the further valves actuated by the main piston. In principle, the control arrangement has at least two further valves, which are capable of triggering independently of each other the various further valves, for example shutoff valves for wastewater and for ventilation.

The second and third valve are connected independently of each other but are arranged parallel.

In accordance with a further proposal of the invention that may be emphasized, a further (fourth) valve emanates from the main piston and is preferably displaceable along the longitudinal axis thereof, which valve closes or opens the connection leading to under-pressure the chamber as a function of the position of the main piston. The further valve closes off the chamber from the connection whenever the main piston has been displaced by rising negative pressure in the chamber, particularly if a negative pressure prevailing in the chamber has caused a displacement of the main piston in the direction of the first valve. The further valve opens the connection again whenever the main piston has moved into its basic position, or in other words whenever a pressure compensation with the surrounding environment has taken place in the chamber.

The further (fourth) valve is displaceable preferably in quasi-telescoping fashion relative to the main piston, and the further valve is disposed with its piston guided in the main piston.

To attain a structurally simple and compact design of the control arrangement, the second and third valves have second and third valve pistons extending parallel to each other and parallel to the main piston and preferably have different lengths or are adjustable in length.

The main piston acts upon the second or third valve piston via at least one driver in such a way that whenever the main piston moves back into its basic position from its position in which it is displaced by negative pressure operative in the chamber, the second or third valve is opened, in order to carry the requisite negative pressure to the aspiration or ventilation valve, as a function of the lengths of the second and third valve pistons or as a function of positions of elements that emanate from the second or third valve piston and cooperate with the driver. The second and third valve close again, however, whenever upon the return displacement of the main piston, its driver comes out of engagement with the second or third valve piston.

The element that emanates from the respective second or third valve piston is preferably an element embodied on the end of the valve piston and embodied as at least peripherally flexible, such as a disk element, with which recesses or protrusions in the driver of the main piston are associated.

Instead of the driver emanating from the main piston and the elements emanating from the second or third valve piston and interacting with the driver, a positive coupling may also be effected via tension or spring elements between the main piston and the second or third valve piston, in order to achieve the same effect.

Regardless of the type of positive coupling, which as mentioned can be effected only intermittently, it is preferably provided that the positive coupling between the main piston and the second and third valve piston is effected such that the second and third valves are opened or closed at different times.

The compact design of the control arrangement results in particular from the fact that it includes a cylindrical housing, along whose center axis the first valve with its valve piston, the main piston, and the further valve piston that is displaceable coaxially with the main piston are displaceably disposed; that the main piston in a known manner is kept guided by a diaphragm, which in pressure-tight fashion closes the chamber, upon which negative pressure can act, on one side, preferably the side opposite the first valve; and that at least one limiter acts, for instance radially, upon the main piston or the fourth valve in such a manner that a displacement of the main piston upon increasing negative pressure or a closure of the fourth valve takes place only at a predetermined negative pressure in the chamber. The limiter may be embodied as spring-actuated ball elements, acting radially upon the main piston or the piston of the fourth valve, which elements can lock at least into a preferably encompassing indentation such as a groove whenever the main piston is located in, or in the vicinity of, its position that it assumes when ambient pressure prevails in the chamber.

If a limiter acts upon the piston of the fourth valve, then a defined opening and closing of the connection to the chamber at unequivocally defined pressures in the chamber, and hence an exact timing control, are achievable.

These provisions assure that the control arrangement will respond only when a negative pressure that suffices to transport wastewater to the requisite extent and in the requisite amount prevails in the negative pressure wastewater system.

The limiter may also be embodied as a magnet, in order to act in the way indicated previously.

The connection that is closeable by the first valve or the further (fourth) valve, by way of which connection the negative pressure is transmitted to the chamber, is moreover advantageously embodied as a line extending in the wall of the housing.

Further details, advantages and characteristics of the invention will become apparent not only from the claims and the characteristics recited in them—alone and/or in combination—but also from the ensuing description of a preferred exemplary embodiment shown in the drawing.

DETAILED DESCRIPTION OF THE INVENTION

Figure 1:
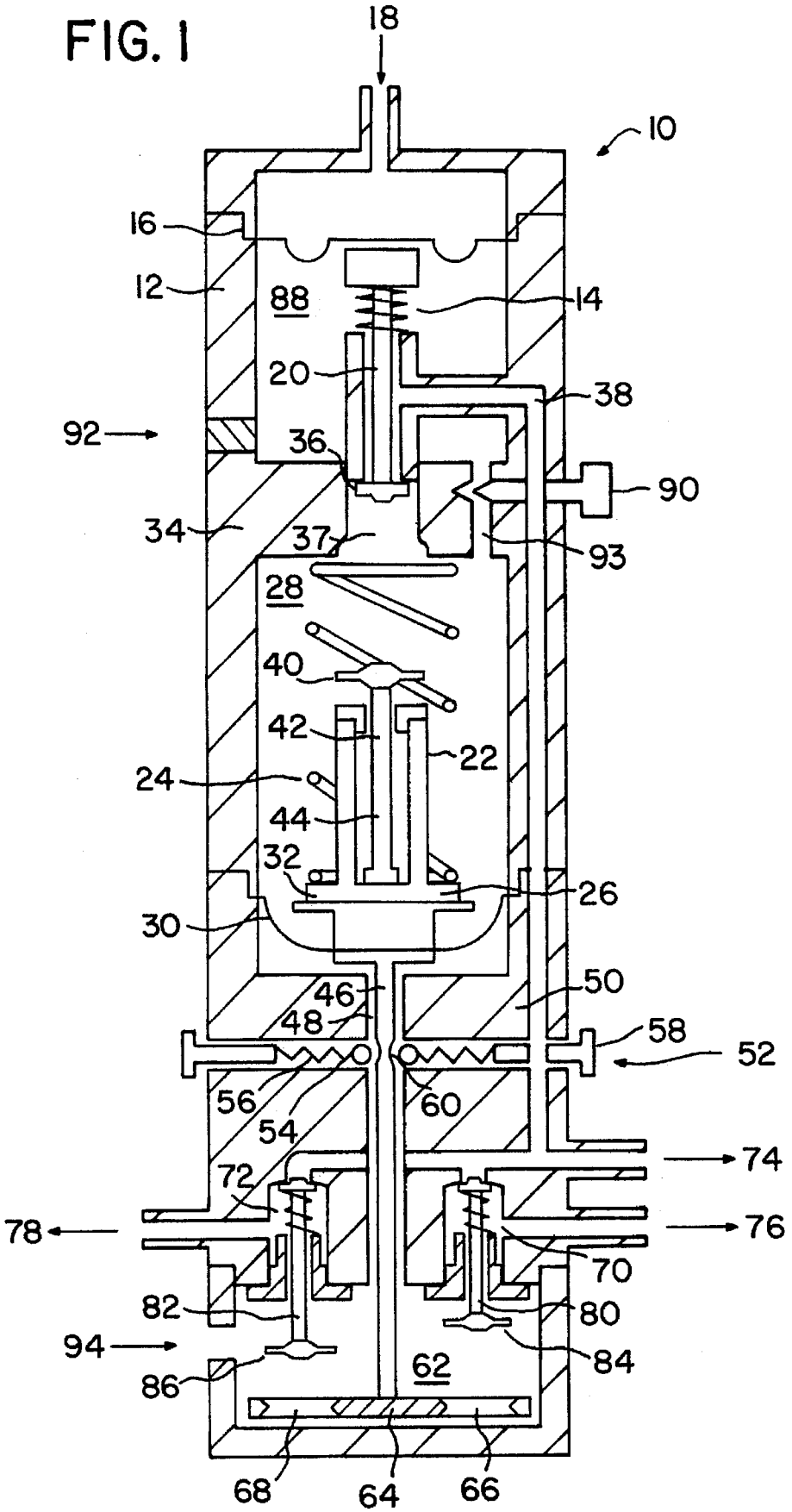
FIG. 1, a basic illustration of a control arrangement having a main piston, in its first terminal position in the absence of hydrostatic pressure.

The design and function of the preferred control arrangement (10) according to the invention will be described in connection with FIGS. 1–8. By way of this arrangement, not only a shutoff valve actuatable by negative pressure but also a ventilation valve, both intended for a negative pressure wastewater system, can be triggered.

The control arrangement (10), functioning without electrical current but pneumatically, includes a cylindrical housing (12), in which a first valve (14) or tripping valve is disposed, which can be acted upon via a diaphragm (16) by an dynamic pressure reaching the housing (12) via an opening (18).

The tripping valve (14) extends with its valve piston (20) along the longitudinal axis of the housing (12). Also displaceable along the longitudinal axis is a main piston (22), which with a larger section (26), acted upon via a helical spring (24), is displaceable in a chamber (28) that performs a timing function. The chamber (28) is sealed off, on the side opposite the tripping valve (14), via a diaphragm (30) that is connected to the main piston (22).

The spiral spring (24) extends between a flangelike section (32) of the main piston having a central opening (37), extending concentrically with the longitudinal axis of the housing (12); one side of opening (37) is closeable via a valve disc (36) of the valve piston (20) of the tripping valve (14) relative to a line (38) that can conduct negative pressure and extends inside the housing wall, and on the other side, it is closeable via a valve disc (40) of a closure valve (42), whose piston (44) is received so as to be displaceable coaxially with the main piston (22) and is guided by that main piston. The valve piston (44) of the closure valve (42) and the main piston (22) form a kind of telescoping rod linkage.

A barlike section (46) of the main piston (22) which is preferably made of special steel, extends from the section (26) of the main piston (22) on the opposite side of the diaphragm (30) with respect to the chamber (28).

The section (46) is guided inside a bore (48) of a further partition (50) of the housing (12). In the exemplary embodiment of FIG. 1, a limiter (52) in the form of ball elements (54) acts upon the piston section (46) in this region. These ball elements are distributed uniformly over the circumference of the section (46) and act radially upon it. The force acting upon the section (46) via the balls (54) is adjustable via spring elements (56), which in turn can be prestressed via adjusting elements (58) that are accessible from outside. Preferably, three ball elements are provided, distributed uniformly over the circumference of the section (46).

The function of the limiter (52) begins whenever the balls (54) have locked into an encompassing grove (60) in the section (46). This is the case whenever the main piston (22) is in first, lower terminal position. Only when an adequately pronounced negative pressure prevails in the chamber (28), the main piston (22) can be displaced upward, according to the preferred embodiment.

The piston section (46) of the main piston (22) extends within a lower chamber (62) of the housing (12) of the control arrangement (10) and has a radially extending disk element (64), acting as a driver, with openings (66) and (68).

In the exemplary embodiment, two switching valves (70) and (72) are also disposed in the partition (50), displaceable paralled to the longitudinal axis of the housing (12) and thus parallel to the main piston (22) and the valve pistons (20) and (44) of the tripping valve (14) and the closure valve (42), respectively. The switching valves (70) and (72), depending on their positions, establish a communication with both a line (74) and connectors (76) and (78) to which negative pressure can be transmitted. The connectors (76), (78) communicate with valves actuatable by negative pressure, preferably in the form of an aspiration valve (connector 76) and a ventilation valve (connector 78) of a negative pressure wastewater system, in order to supply wastewater with the requisite amount of air for transport purposes.

The switching valves (70) and (72) have valve pistons (80) and (82), which on their ends extending within the chamber (72) have dislike elements (84) and (86), which are embodied elastically, at least peripherally. The size of the elements (84), (86) is adapted to the openings (66) and (68) of the driver (64) of the main piston (22) in such a way that on the one hand, when the switching valves (70) and (72) are entirely closed or entirely opened, the elements (84), (86) pass through the openings (66) and (68), but on the other hand whenever the main piston (22), in the manner described below, moves from a second (upper) terminal position, shown in FIG. 3, into its first terminal position, shown in FIG. 1, these elements (84), (86) are engaged by the driver (64) and carried along with it.

The drawing also clearly shows that a further intermediate chamber (88) extends between the partition (34) of the housing (14) and the diaphragm (16) that can be acted upon by hydrostatic pressure, and this intermediate chamber communicates, via a line (93) whose cross section is variable via an adjusting element (90), with the chamber (28) that is called the timer. Via an opening (92) in the housing wall having an air filter inserted, the chamber (88) also communicates with the surroundings of the control arrangement (10).

FIG. 1 shows the control arrangement according to the invention in a position in which the main piston (22) is in its lower (first) terminal position. Moreover, a hydrostatic pressure is not transmitted to the diaphragm (16) via the opening (18). When negative pressure is transmitted via the connector (74), both the tripping valve (20) and the switching valves (70) and (72) are closed. Consequently, ambient pressure prevails both in the chamber (28) and at the connectors (76) and (78) to the aspiration valve and the ventilation valve, so that the latter valves are closed; this is because on the one hand the lower chamber (62) of the housing (12) communicates with the surroundings via an opening (94), and on the other hand the valve pistons (80) and (82) of the second valves (70) and (72) pass through the guides that receive them in the partition (50) with play. In addition, each of the valve pistons (80) and (82) may have a slit, not identified by reference numeral, whose length is such that when the valves (70) and (72) are closed, communication is established between the chamber (62) and the connectors (76) and (78).

Figure 2:
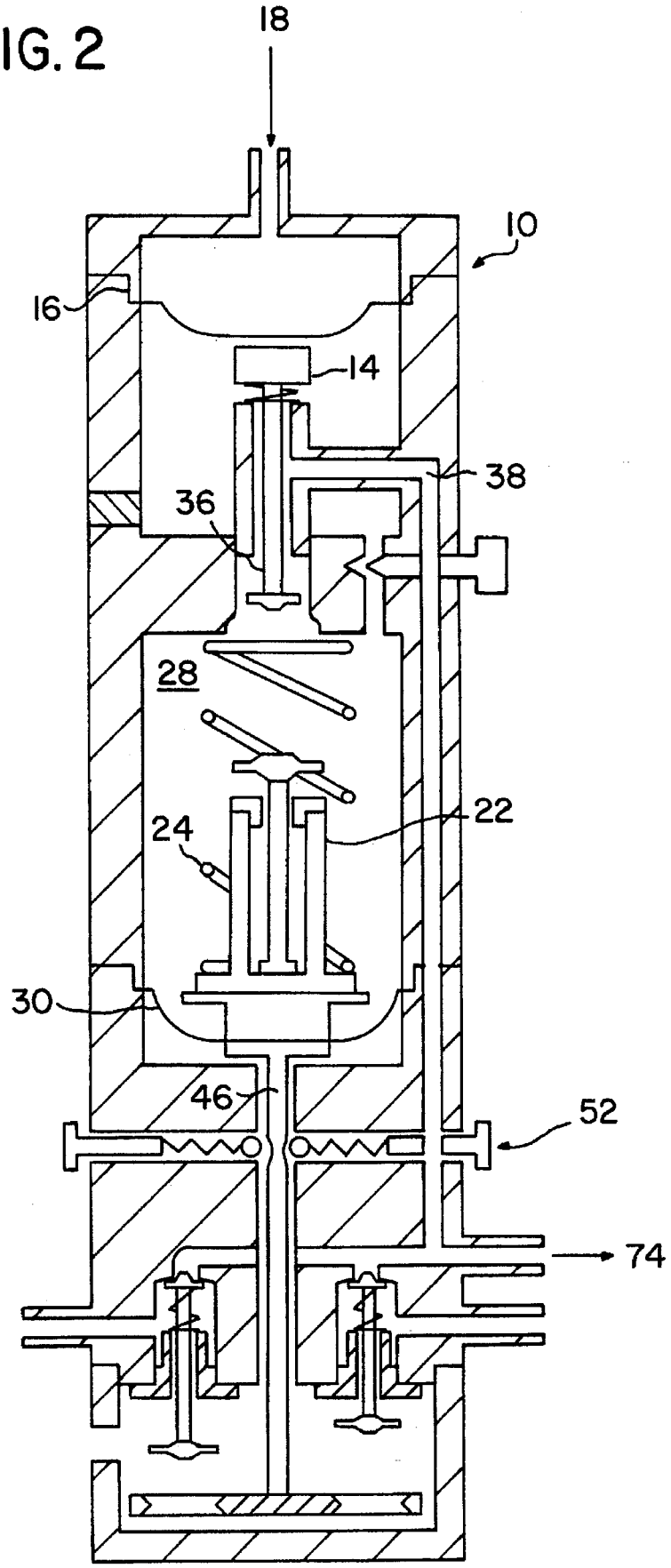
FIG. 2, the control arrangement of FIG. 1, but after hydrostatic pressure is present.

If as shown in FIG. 2 hydrostatic pressure is transmitted via the opening (18), then the diaphragm (16) is deflected in the direction of the main piston (22); consequently the tripping valve (14) is displaced and thus the valve disc (36) is lifted from the valve seat, and as a result a negative pressure is transmitted into the chamber (28) via the connector (74) and the line (38). If the negative pressure is so pronounced that the force exerted by the limiter (52) on the section (46) of the main piston (22) can be overcome, then the main piston (22) is displaced from its first terminal position (FIG. 2) into its second terminal position (FIG. 3), counter to the force exerted by the spring (24). A purely axial motion takes place, since a rotation of the main piston (22) is precluded due to its support by the diaphragm (30).

As soon as the main piston (22) is in its upper terminal position, the opening (37), present in the partition (34) and communicating with the negative pressure line (38), is closed via the closure valve. (42). In other words, the valve disc (40) of the closure valve (42) covers the opening (37). Consequently, further negative pressure can no longer be transmitted to the chamber (28) via the line (38). Instead, via the opening (92) and the air filter, the chamber (88) and the line (93) of adjustable cross section, a gradual pressure compensation takes place, with the consequence that the main piston (22) moves slowly from its second terminal position (FIG. 3) back in the direction of its first terminal position However, since the closure valve (42) can move relative to the main piston (22), the closure valve (42) continues to close the opening (37), since it is kept in the closing position by the negative pressure present via the line (38).

Figure 3:
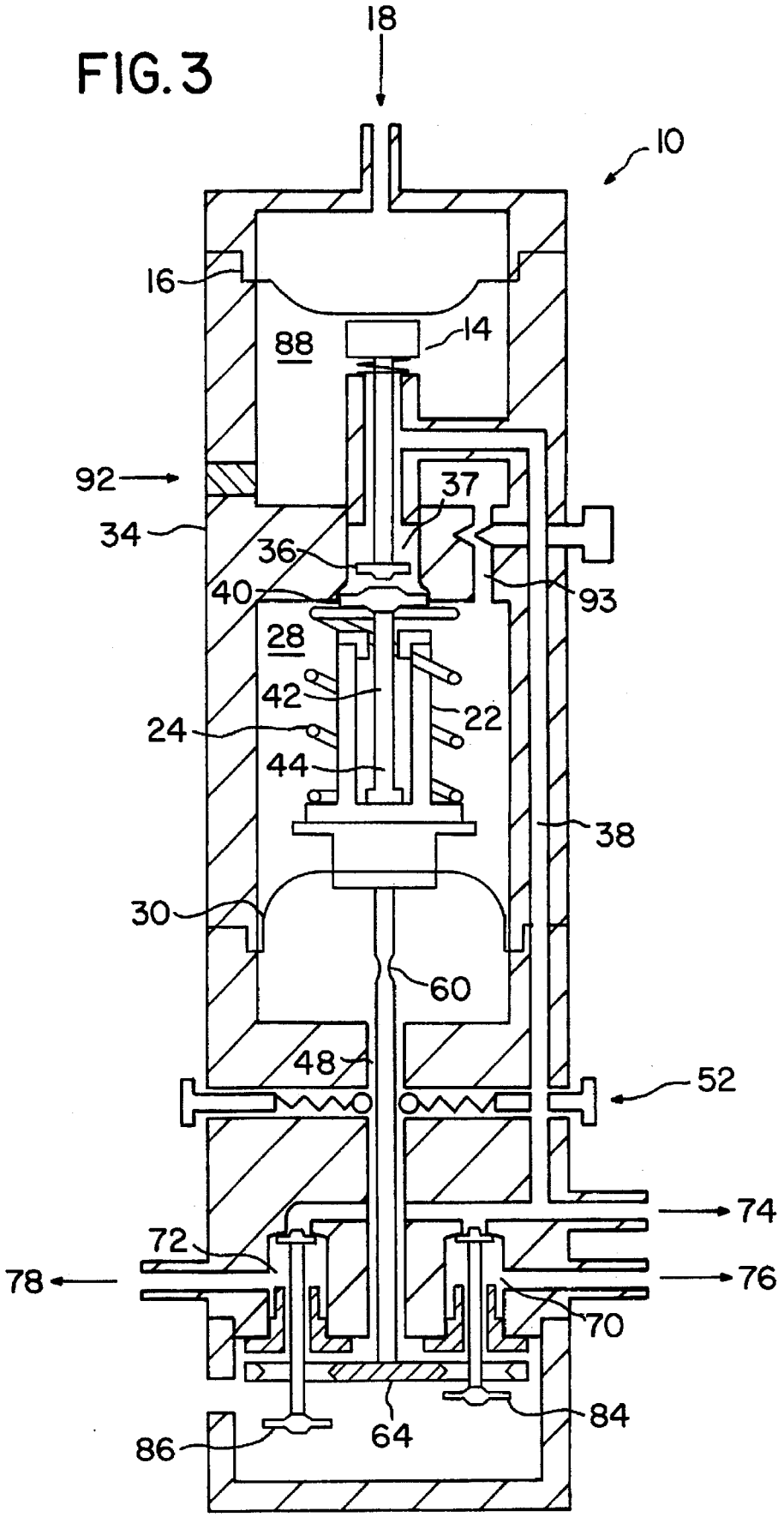
FIG. 3, the control arrangement of FIG. 2, but with the main piston located in its second terminal position.

As FIGS. 1–3 clearly show, when the main piston (22) is displaced into its upper terminal position, the platelike elements (84) and (86) of the switching valves (70) and (72) pass through the openings (66) and (68) of the driver (64), without any change in position of the switching valves (70) and (72).

Figure 4:
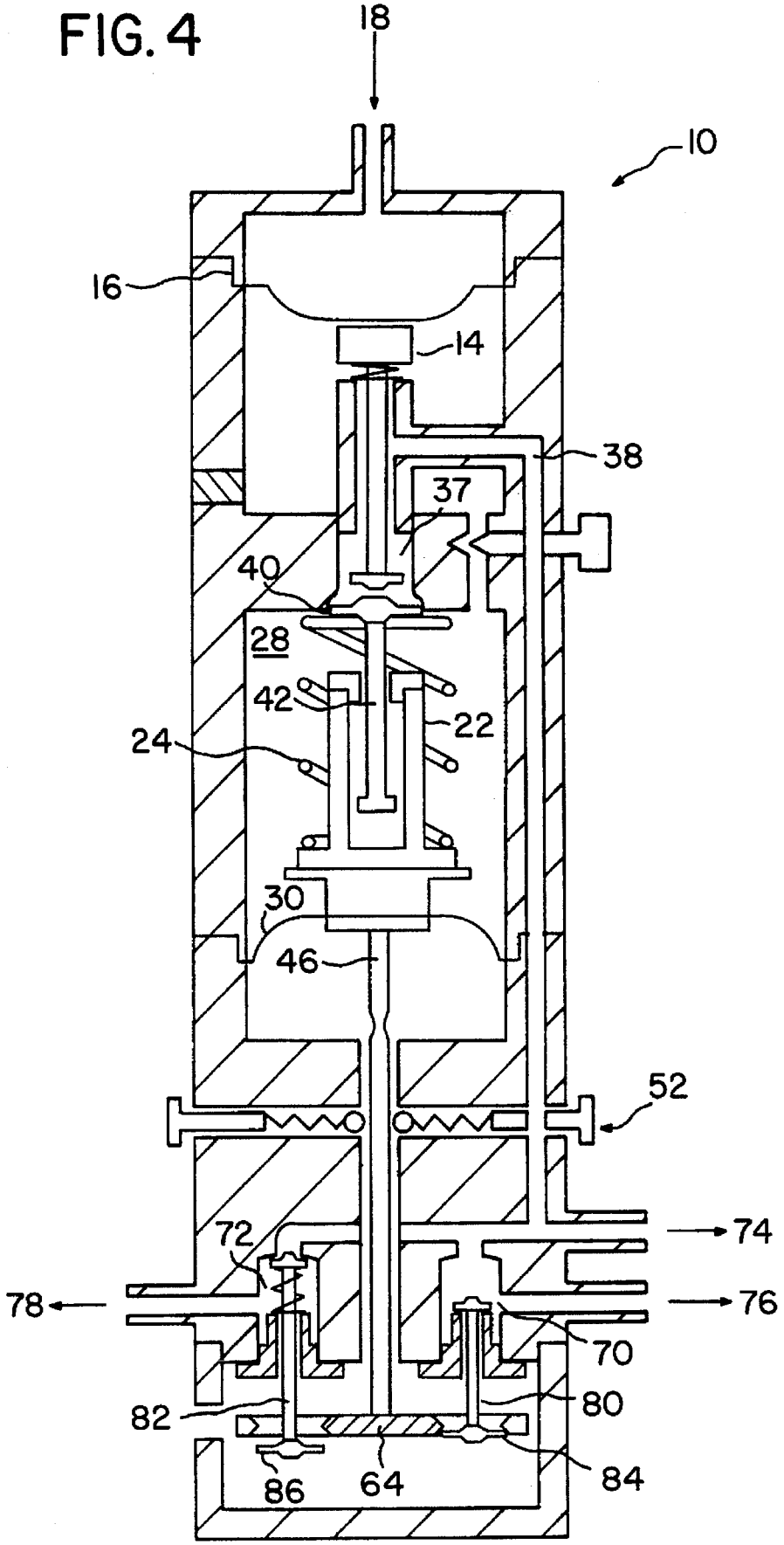
FIG. 4, the control arrangement of FIG.3, in which the main piston has moved from its second terminal position in the direction of the first terminal position.
Figure 5:
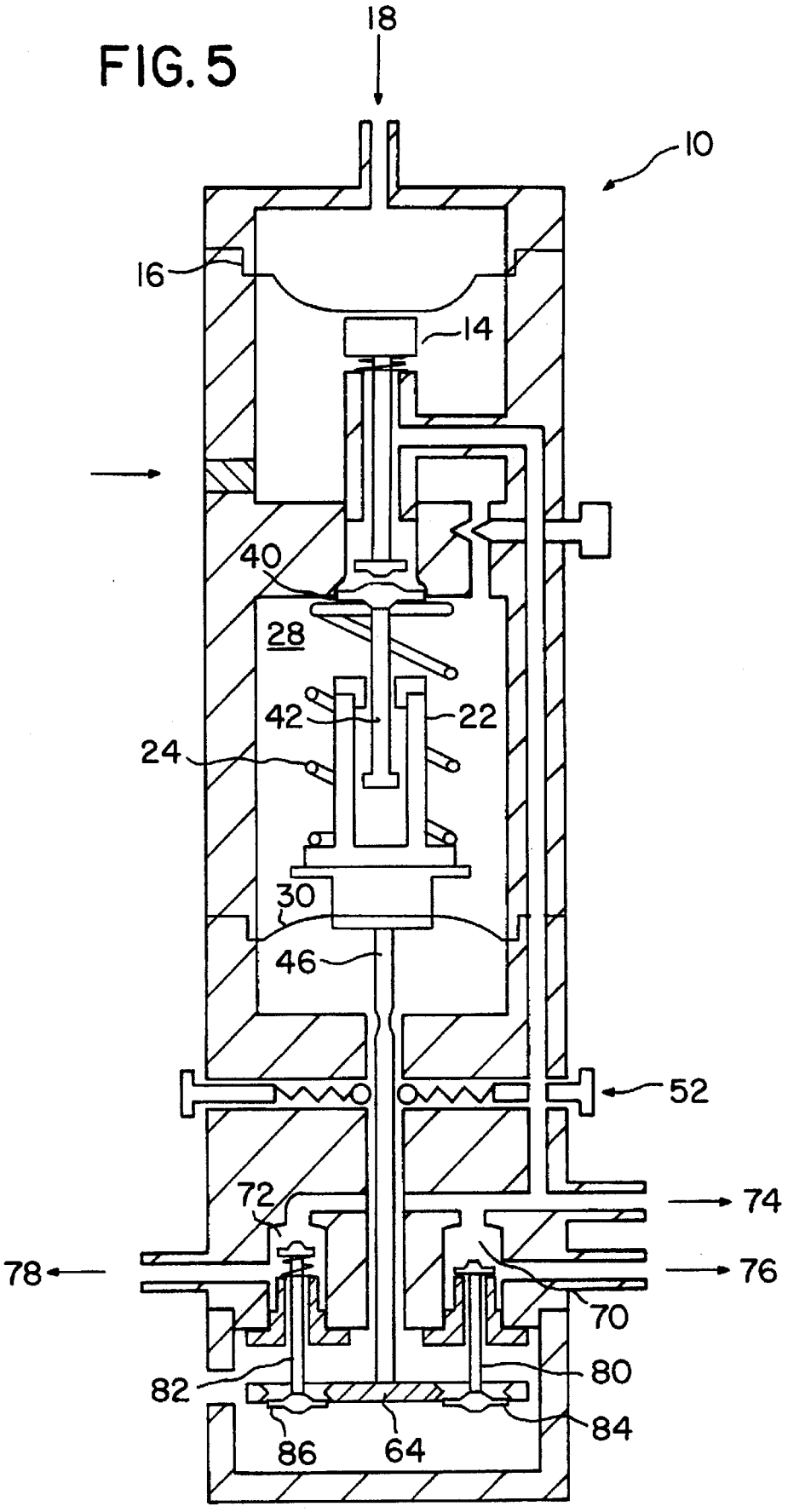
FIG. 5, the control arrangement of FIG.4, in which the main piston has moved farther in the direction of the first terminal position.

Upon the return motion of the main piston (22), however, the dislike element (84) of the switching valve (70) is engaged by the driver (64), with the result that the switching valve (70), which via the connector (76) triggers the aspiration valve, is opened (FIG. 4). The requisite negative pressure for opening the aspiration valve can then be transmitted to that valve, so that wastewater can be aspirated.

Since the valve piston (82) of the switching valve (72), by way of which the ventilation valve is triggered, is longer than the valve piston (80) of the switching valve (70), the switching valve (72) initially still remains closed even when the switching valve (70) is opened. Nothing but wastewater is aspirated.

Upon further return motion of the main piston (22) (FIG. 5), element (86) of the switching valve (72) is engaged by the driver (64), so that the switching valve (72) can be opened and negative pressure can reach the ventilation valve via the connector. (78).

According to the dimensions of the valve pistons (80) and (82) of the switching valves (70) and (72) as shown in the drawings, these valves can be opened simultaneously, so that an overlap in aspiration of wastewater and air can occur.

However, by changing the length of the valve pistons (80) and (82), it is also attainable that the valves are open successively.

Figure 6:
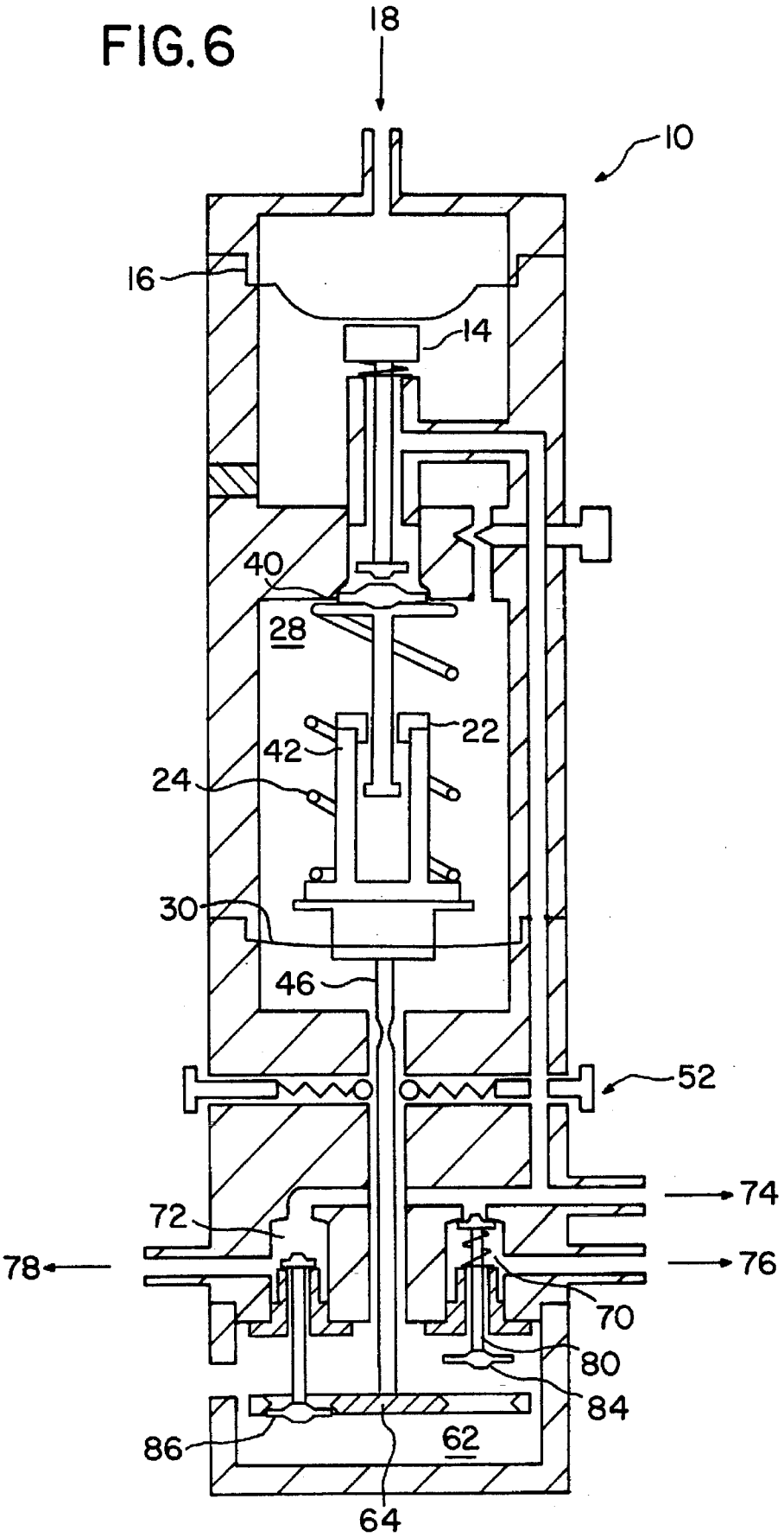
FIG. 6, the control arrangement of FIG. 5, with the main piston in a position located even closer to the first terminal position.
Figure 7:
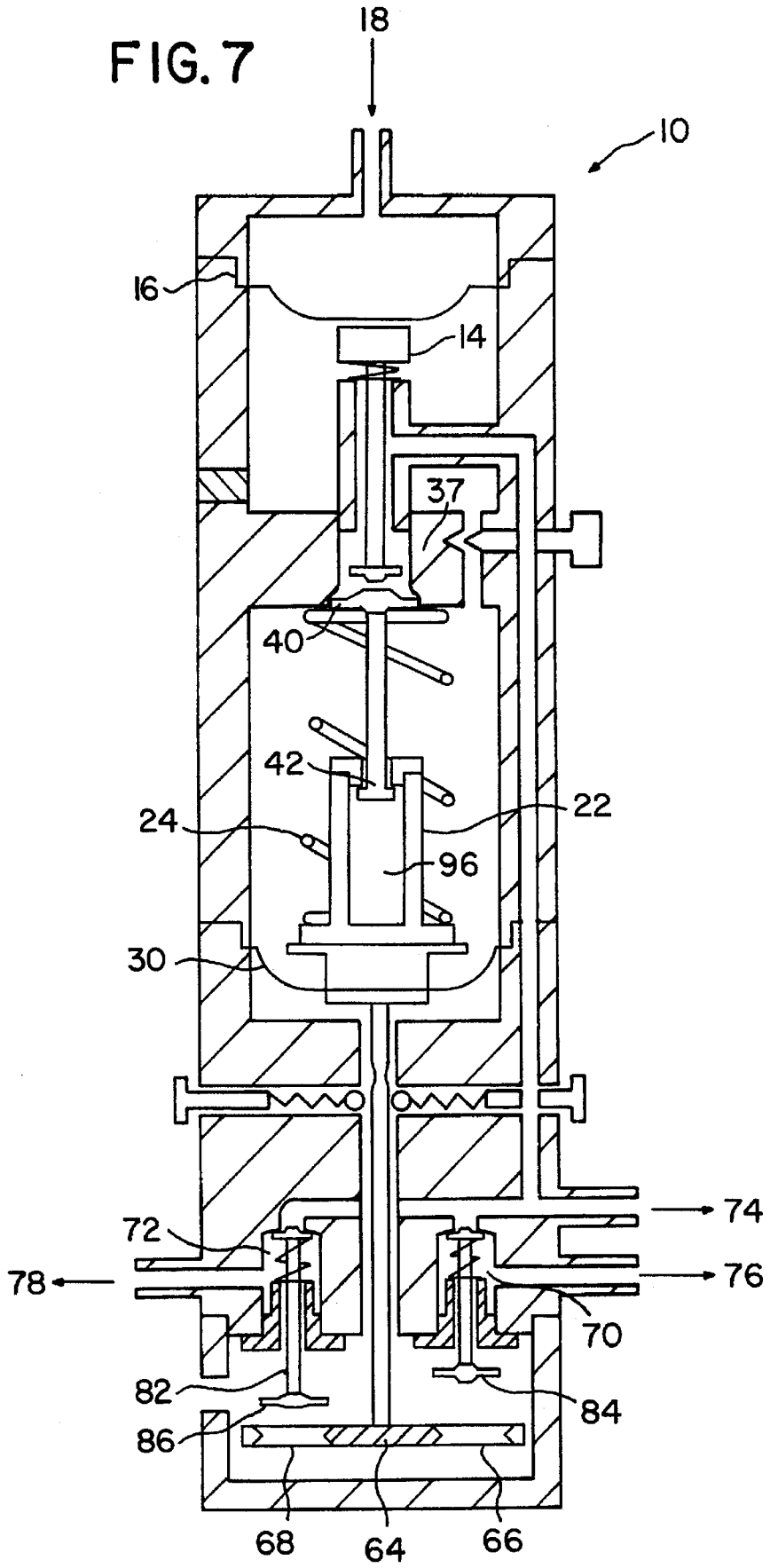
FIG. 7, the control arrangement of FIG.6, in which the main piston is located shortly before its first terminal position.

As shown in FIG. 6, the disklike element (84) of the switching valve (70) skips above the driver (64) whenever the main piston (22), when the switching valve (70) is in its lower terminal position, is displaced farther in the direction of its first terminal position. The switching valve (70) is closed, so that via the chamber (62) and the slit present in the valve piston (80), a pressure compensation can take place via the connection (76) at the aspiration valve, so that this valve is closed.

Conversely, in the exemplary embodiment, the switching valve (72) that triggers the ventilation valve continues to be open. Not until the main piston (22) has been displaced still farther toward its first terminal position (FIG. 7) does the disklike element (86) also skip above the driver (64), or in other words passes through its opening (68), so that the switching valve (72) closes. Hence no further negative pressure is present at the connector (78). At the same time, a pressure compensation takes place via the chamber (62) and the slit in the piston rod (82). However, it should be mentioned that a slit need not necessarily be present, since the piston rod (82) is guided with play.

Figure 8:
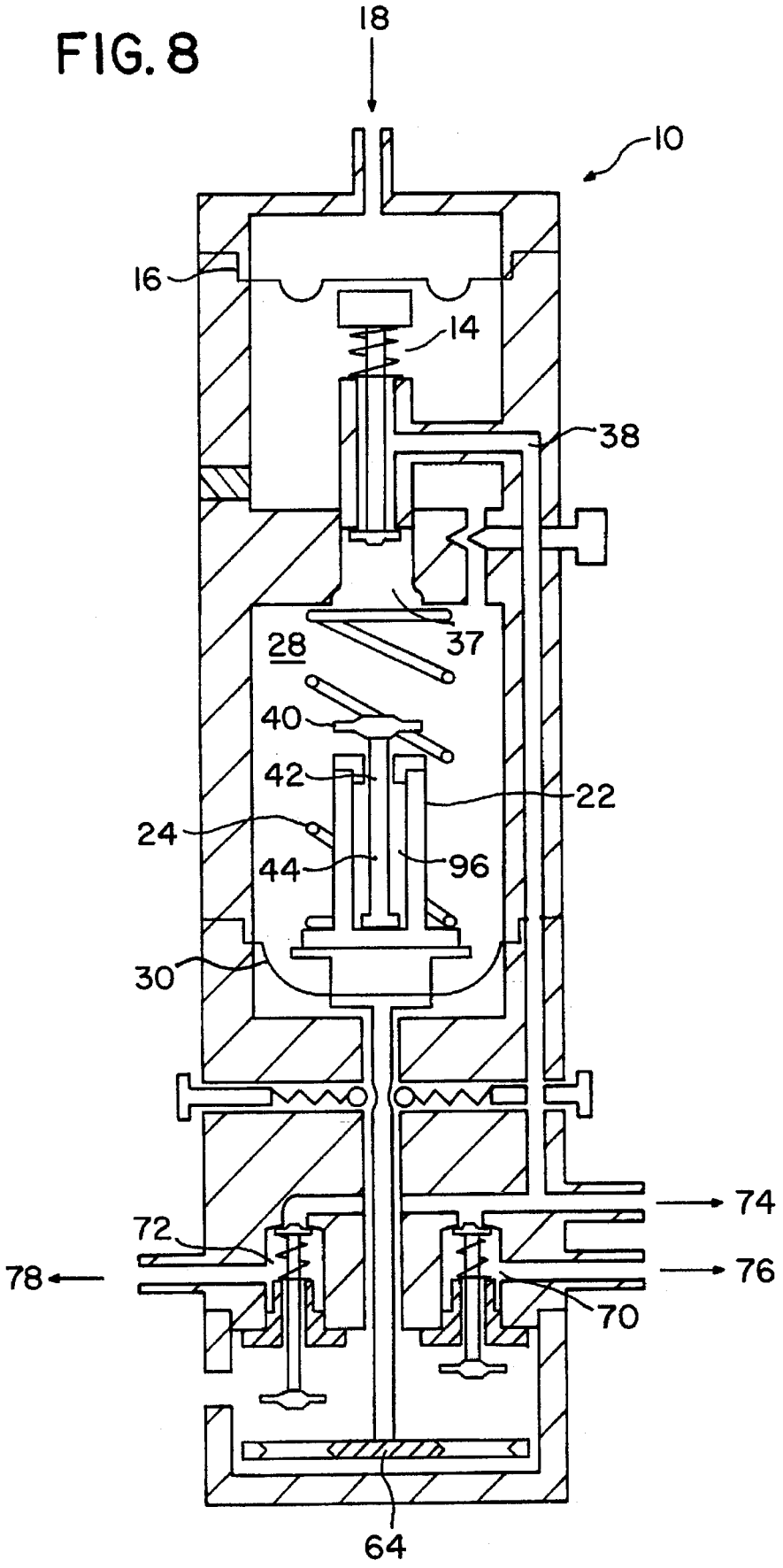
FIG.8, the control arrangement of FIG. 7, in which the main piston is in its first terminal position and a hydrostatic pressure is not present.

Shortly before the main piston (22) reaches its first terminal position (its lower position as shown in the drawing), the closure valve (42) is torn away from the opening (37) and can drop back by gravity into a cylindrical opening (96), of the section (26) of the main piston (22), receiving the valve piston (44) (FIG. 8).

If no further hydrostatic pressure is transmitted to the diaphragm (16) via the opening (18), the tripping valve (14) remains closed due to the negative pressure prevailing in the line (38), thus the control arrangement (10) is again in its basic position (FIG. 1).

However, if he diaphragm (16) continues to be acted upon by hydrostatic pressure, then the mechanism described above begins all over again.

Although in the exemplary embodiment the main piston (22) is related to two switching valves (70, 72), it is naturally also possible to actuate only one switching valve or more than two switching valves via the main piston (22). If a plurality of switching valves are present, then they can also each trigger one aspiration valve.

Finally, if two or more switching valves are present, it is also possible to use only one of them, by closing off the connectors related to the other switching valves.

Figure 9:
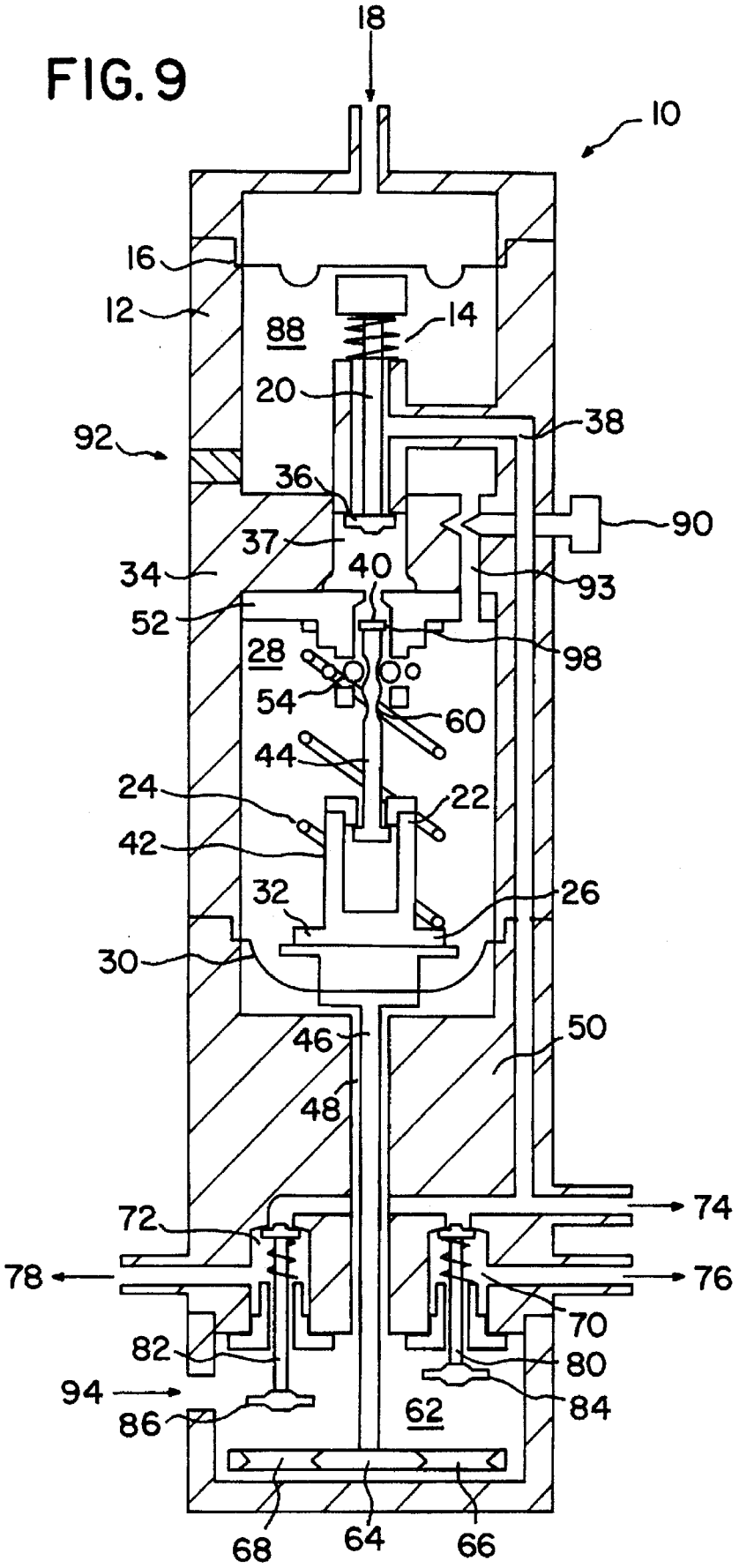
FIG.9, an illustration corresponding to the embodiment of FIG. 1, with a disposition of a limiter different from that of FIG. 1.

FIG. 9 shows a variant of the control arrangement in FIGS. 1–8, in which a limiter acts not on the main piston (22), or its section (46), but rather upon the valve piston (44) of the closured valve (42). This is intended to assure an unequivocal open/closed position of the closure valve (42).

For this purpose, the valve piston (22) has two separate grooves (60), into which ball elements (54) lock whenever the closure valve (42) is in its opened or closed position. Via the ball elements (54), radial forces are exerted upon the valve piston (44); these forces are produced by a tension ring (98) circumferentially surrounding the ball elements (54). In order to preclude slippage of the ball elements (54) and tension ring (98), these elements are disposed in an encompassing recess of the partition (34), of a section emanating therefrom, in which in turn the valve seat for the valve disc (40) of the closure valve (42) extends.

As a result of the embodiment of the limiter (54) shown in FIG. 9, an unequivocal opening or closing of the chamber (28), and hence its time switch function , is assured.

Naturally, the limiters of FIGS. 1 and 9 may also be provided simultaneously. Other technologically equivalent limiters may also be employed.

Figure 10:
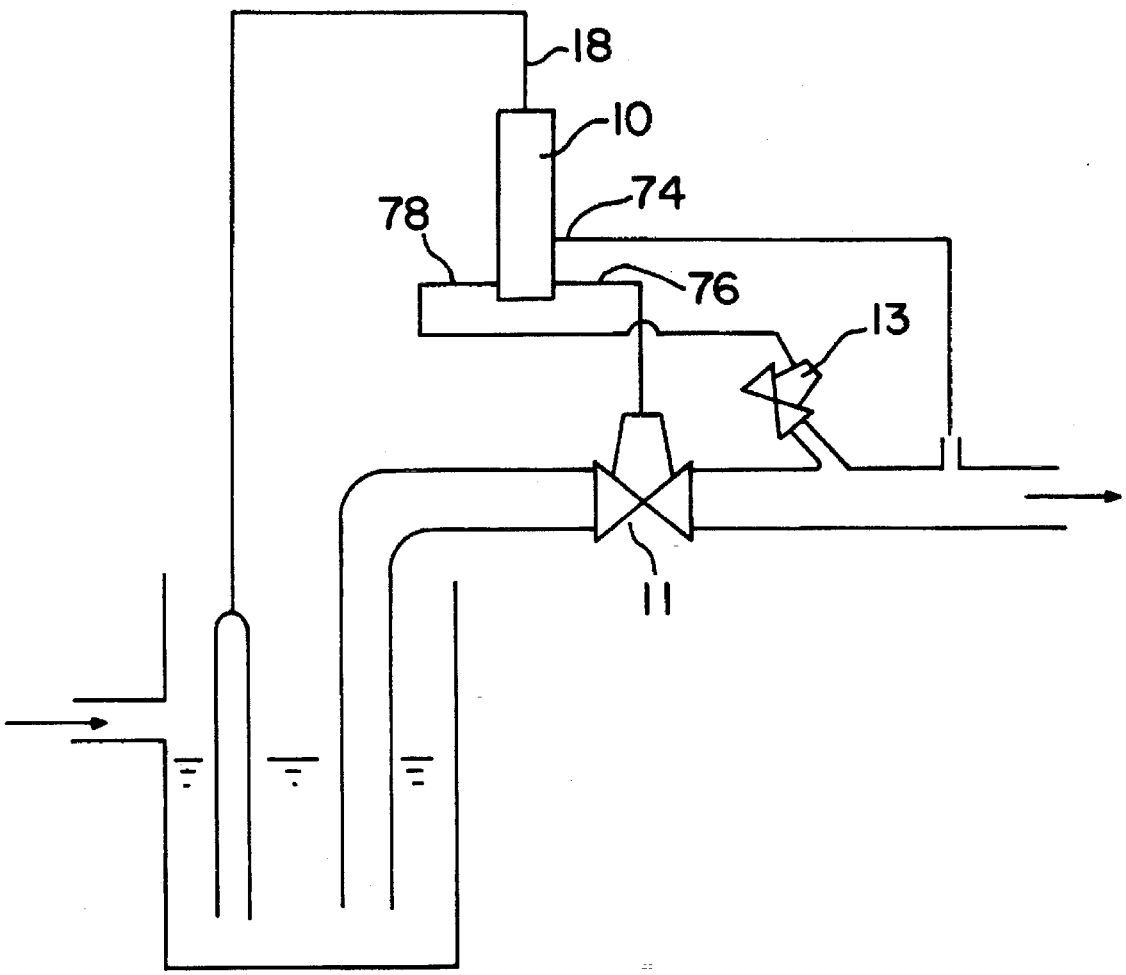
FIG. 10 shows the connection lines between the shutoff valve and ventilation valve.

FIG. 10 shows the connection lines 74, 76, 78, the shutoff valve 11 arranged in the connection line 76 and ventilation valve 13 in connection line 78.

I claim:

1. For use in a negative pressure wastewater system, a control arrangement (10) for a shutoff valve (11) actuated by negative pressure, said control arrangement comprising: a first valve (14) that is actuated by static pressure resulting from accumulated wastewater and that opens a normally closed connection (38) transmitting negative pressure, a chamber (28) which is evacuated as negative pressure is transmitted through said connection when the first valve (14) is actuated and in which a main piston (22) is acted upon by a spring (24), said main piston is displaceably disposed, as a function of the pressure prevailing in the chamber (28), at least a second valve (70) which is positively coupled to the main piston (22) and which controls a negative pressure connection (76) to said shutoff valve (11), and the control arrangement (10) further incudes a third valve (72), which is positively coupled to the main piston (22) and which controls a further negative pressure connection (78) to a ventilation valve (13) for its operation that delivers air into the negative pressure wastewater system.

2. For a vacuum type wastewater system, where wastewater is aspirated by negative pressure, a control arrangement (10) to control the flow of wastewater through a shutoff valve (11) which opens upon application of negative pressure thereto, said control arrangement comprising:

a first valve (14) actuated by static pressure resulting from accumulated wastewater, a main chamber (28) in which negative pressure is transmitted via a connection (38) upon the first valve (14) being actuated, a main piston (22) biased by a spring (24) towards a first position and displaced towards a second position by the negative pressure prevailing in the main chamber (28), a driver (64, connected to said main piston (22)

a second valve (70) transmitting negative pressure to the shutoff valve (11) so as to enable wastewater aspiration, and a third valve (72) independent from the main piston but operable by the driver (64) for opening a further negative pressure connection (78) to a ventilating valve (13) which is opened by negative pressure and delivers air into the vacuum type wastewater system.

3. The control arrangement of claim 2, wherein the second and third valves (70,72) have second and third valve pistons (80,82) extending parallel to each other and parallel to the main piston (22).

4. The control arrangement of claim 3, wherein the second and third valve pistons (80,82) have lengths that differ from each other.

5. The control arrangement of claim 3, wherein in the length of the second and third valve piston length can be adjusted.

6. The control arrangement of claim 3, wherein the driver (64) is connected to the main piston (22) by a bar-like portion and acts upon the value pistons (80,82) in order to control the second and third valves (70,72).

7. The control arrangement of claim 2, wherein a positive coupling via spring elements (84,86) is effected between the, driver (64) and each of the second and third valves (70,72).

8. The control arrangement of claim 2, wherein a positive coupling between the main piston (22) and the second and the third valves (70,72) is effected such that the third valve (72) is not opened until re-closure of the second valve (70).

9. The control arrangement of claim 2, wherein the second and the third valves (70,72) are opened at overlapping times.

10. The control arrangement of claim 2, wherein a fourth valve (42) has a piston (44) forming a rod linkage with the main piston (22) which is displaceable along a longitudinal axis, said fourth valve (42) closes or opens the connection (38) as a function of the position of the main piston.

11. The control arrangement of claim 10, wherein a limiter (52) acts upon the main piston (22) and the fourth valve (42) in such a way that the fourth valve (42) can be closed by displacement of the main piston (22) from its first to its second position only when the negative pressure in the main chamber (28) exceeds a present value.

12. The control arrangement of claim 11, wherein the limiter (52) is embodied as spring-actuated ball elements (54), acting radially upon the main piston (22, 46), which ball element, in a first terminal position of the main piston, can lock into an encompassing indentation 60 of the main piston, such as a groove (60).

13. The control arrangement of claim 11, wherein the limiter (52) includes ball elements (54) acting radially upon the piston (44) of the fourth valve (42), which ball elements lock in detent fashion into indentations such as grooves when the fourth valve is opened or closed, and a tension element such as a tension ring (98) that surrounds the ball elements acts upon them.

14. The control arrangement of claim 10, wherein the connection (38) carrying the negative pressure to the chamber (28) is closeable by the first or fourth valve (14,42).

15. The control arrangement of claim 10, wherein the fourth valve (42) is received, guided in telescoping fashion, by the main piston (22).

16. The control arrangement of claim 11, wherein the fourth valve (42) closes the chamber (28) relative to the underpressure connection (38) when the main piston (22) is displaced to its second terminal position, so that evacuation of the chamber (28) via the connection (38) is interrupted, a connection (92,93) between the chamber (29) and the atmosphere admits air into the chamber (28) and compensates the pressure in the chamber (28) while the connection (38) is kept closed, the main piston (22) is displaced from its second to its first position as the pressure is compensated and opens the fourth valve (42).

17. Control arrangement of claim 11, wherein the limiter is formed by a magnet which is connected to the main piston (22) and interacts with a housing (12) of the control arrangement when the main piston (22) is in its first position.

18. The control arrangement of claim 3, wherein the valve pistons (80,82) of the second and third valves (70,72) comprise peripherally flexible elements (84,86) which can penetrate openings (66,68) in the driver (64) during the displacement of the main piston (22) and the driver (64) following a complete opening or closing of the second and third valve (70,72).

19. The control arrangement of claim 3, wherein the driver (64) of the main piston (22) is in the form of a plate which hasopenings (66,68) for engaging disk elements (84, 86) of the second and third valve pistons (80,82) during displacement of the main piston (22) from its first to its second position.

20. The control arrangement of claim 2, wherein the control arrangement is in the form of a cylindrical housing (12), along the center axis of which the first valve (14), the main piston (22) and a fourth valve (42) are displaceably disposed, the main piston is connected with the housing (12) by a diaphragm (30) that on one side closes the chamber (28) in pressure-tight fashion so that negative pressure in the main chamber (28) exerts a force on the diaphragm (30) and on the main piston (22) driving it towards its second position.

* * * * *